US006161900A

United States Patent [19]

Wang

[11] Patent Number: 6,161,900

[45] Date of Patent: Dec. 19, 2000

[54] ADJUSTABLE AND DETACHABLE ARMREST FOR CHAIRS

[76] Inventor: Ching-Chang Wang, P.O. Box 63-247, Taichung, Taiwan

[21] Appl. No.: 09/479,656

[22] Filed: Jan. 10, 2000

[51] Int. Cl.[7] ..... A47C 7/54

[52] U.S. Cl. ..... 297/411.38; 297/411.27

[58] Field of Search ..... 297/411.26, 411.38, 297/411.27, 411.35

[56] References Cited

U.S. PATENT DOCUMENTS 5,316,373 5/1994 Markel ..... 297/411.26
5,597,209 1/1997 Bart et al. ..... 297/411.35
5,678,896 10/1997 Chung ..... 297/411.38
5,733,010 3/1998 Lewis et al. ..... 297/411.35

*Primary Examiner*—Anthony D. Barfield
*Attorney, Agent, or Firm*—Rosenberg, Klein & Lee

[57] ABSTRACT

An armrest includes a main body including a mounting portion, a cover attached to a first side of the mounting portion, and an attachment device having a first end mounted to a second side of the mounting portion and a second end releasably mounted to a chair. The main body has a number of angular positions relative to the attachment device. The main body is releasably engaged with the first end of the attachment device when the main body is in any one of the angular positions.

8 Claims, 6 Drawing Sheets

A-A 37
60
30
15
35
36
32
31
11
14
10
50
25
24
22
23
26

ADJUSTABLE AND DETACHABLE ARMREST FOR CHAIRS

BACKGROUND OF THE INVENTION

1. Field of the Invention

The present invention relates to an armrest for chairs in which the armrest is adjustable relative to a seat of a chair to which the armrest is mounted. The armrest is also detachable from the chair seat to allow easy maintenance.

2. Description of the Related Art

Most chairs have an adjustable backrest to allow comfort sitting, yet the armrest of the chair is not adjustable in response to adjustment of the backrest. Thus, the user may feel uncomfortable. In addition, assembly of the armrest is troublesome, time-consuming, and labor-intensive. If a chair is damaged in the armrest portion, the whole armrest must be replaced and the chair must be returned to the manufacturer for repair if the user cannot repair it on his/her own. In some cases the repair takes a long time and costs a considerable amount of money when compared with the overall cost for a new chair. As a result, the user often chooses to buy a new chair rather than repairing the damaged one. Further, the color of the armrest is predetermined and thus provides a monotonous outlook after it has been attached to a chair seat.

The present invention is intended to provide an improved armrest that mitigates and/or obviates the above problems.

SUMMARY OF THE INVENTION

It is a primary object of the present invention to provide an armrest that is adjustable in an angular position relative to the chair seat to meet the end of the user.

It is another object of the present invention to provide an armrest that can be easily detached from the chair seat such that the user may change the color of the armrest whenever he/she likes and that the user may only replace the damaged portion of the armrest instead of changing the whole armrest to thereby save the cost for repair.

An armrest in accordance with the present invention comprises:

a main body including a mounting portion having a first side and a second side;

a cover attached to the first side of the mounting portion; and an attachment means having a first end mounted to the second side of the mounting portion and a second end adapted to be releasably mounted to a chair;

the main body having a plurality of angular positions relative to the attachment means, the main body being releasably engaged with the first end of the attachment means when the main body is in any one of the angular positions.

The mounting portion includes a first side with a first recess and a second side with a second recess. The first recess and the second recess are separated by a partition wall therebetween, the partition wall including at least one engaging hole and at least two first through-holes. The cover includes at least one engaging member extended from a side thereof. A fixing plate is securely attached to the side of the cover and includes at least one second through-hole. The engaging member of the cover is extended through the second through-hole of the fixing plate and the engaging hole of the partition wall. The fixing plate further includes at least two screw holes respectively aligned with said at least two first through-holes of the partition wall.

The first end of the attachment means includes a first attachment member and the second end of the attachment means includes a second attachment member that is integrally formed with the first attachment member. The second attachment member includes at least one hole for engaging with a chair seat. The first attachment member includes at least one projection formed on a side thereof. The projection has a third through-hole therein. A bolt is extended through the third through-hole of the projection and one of said at least two first through-holes of the partition wall and engaged with one of said at least two screw holes of the fixing plate.

The side of the cover includes an annular wall defining a space therein. The engaging member is located in the space. The fixing member has a diameter slightly smaller than an inner diameter of the annular wall so as to be fittingly received in the space. The annular wall has an outer diameter slightly smaller than an inner diameter of the first recess so as to be fittingly received in the first recess.

The side of the first attachment member includes an annular wall. The projection is located inside the annular wall. The annular wall has an outer diameter slightly smaller than an inner diameter of the second recess so as to be fittingly received in the second recess.

In accordance with a preferred embodiment of the invention, an armrest comprises:

a main body including a mounting portion having a first side with a first recess and a second side with a second recess, the first recess and the second recess being separated by a partition wall therebetween, the partition wall including two diametrically disposed engaging holes and a plurality of annularly spaced first through-holes;

a cover attached to the first side of the engaging portion, the cover including two diametrically disposed engaging members extended from a side thereof, a fixing plate being securely attached to the side of the cover, the fixing plate including two second through-hole, said engaging members of the cover being extended through said second through-holes of the fixing plate and said engaging holes of the partition wall, the fixing plate faker including a plurality of screw holes respectively aligned with the first through-holes of the partition wall; and an attachment means having a first attachment member mounted to the second side of the mounting portion and a second attachment member that is integrally formed with the first attachment member and that is adapted to be releasably mounted to a chair, the first attachment member including two diametrically disposed projections formed on a side thereof, each said projection having a third through-hole therein, further comprising two bolts each of which is extended through the third through-hole of each said projection and one of said first through-holes of the partition wall and engaged with one of said screw holes of the fixing plate;

whereby the main body has a plurality of angular positions relative to the attachment means and is swivelable relative to the attachment means when the bolts are removed, the main body is releasably engaged with the first attachment member and retained in one of the angular positions by said bolts.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
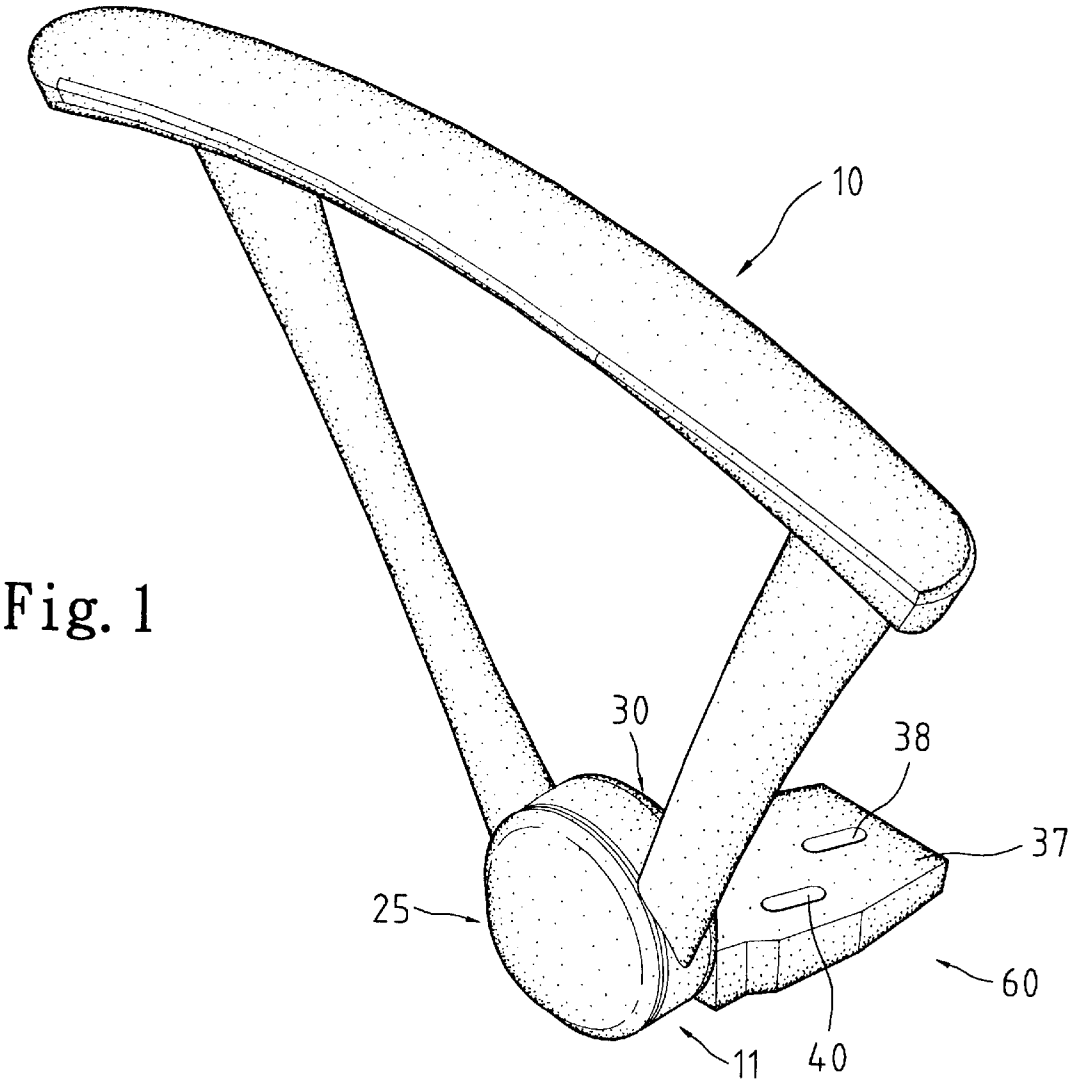
FIG. 1 is a perspective view of an armrest in accordance with the present invention.
Figure 2:
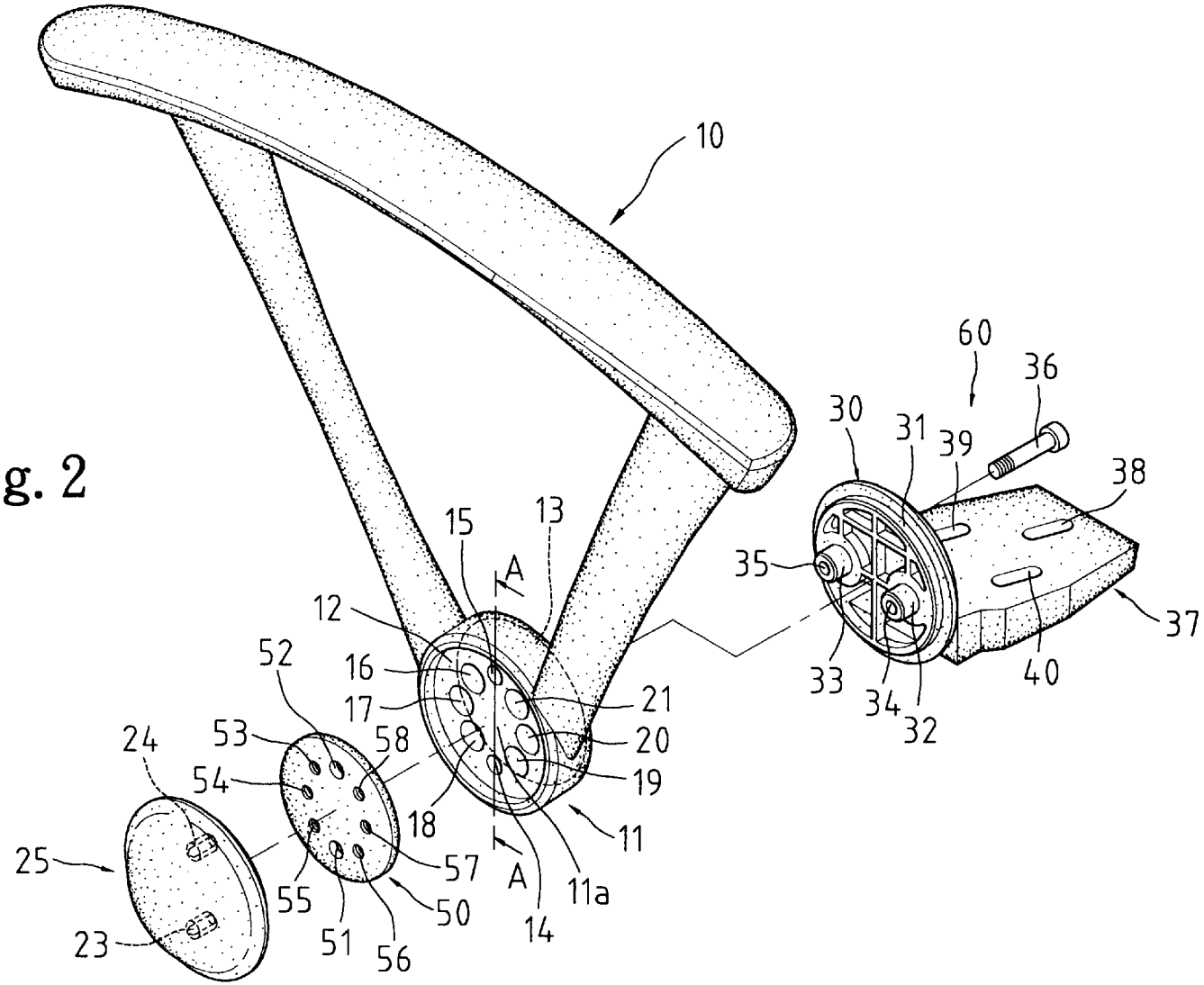
FIG. 2 is an exploded perspective view of the armrest in accordance with the present invention.

Referring to FIGS. 1 and 2, an armrest in accordance with the present invention generally includes a main body 10, a cover 25, a fixing plate 50, and an attachment means 60. The main body 10 includes a mounting portion 11 having a first recess 12 in a first side thereof and a second recess 13 in a second side thereof, the first recess 12 and the second recess 13 being separated by a partition wall 11*a* (FIG. 2). The first recess 12 and the second recess 13 are preferably circular. The partition wall 11 a includes two engaging holes 14 and 15 which are preferably diametrically disposed. A plurality of through-holes 16, 17, 18, 19, 20, and 21 are arranged between the engaging holes 14 and 15 along a circle.

Figure 3:
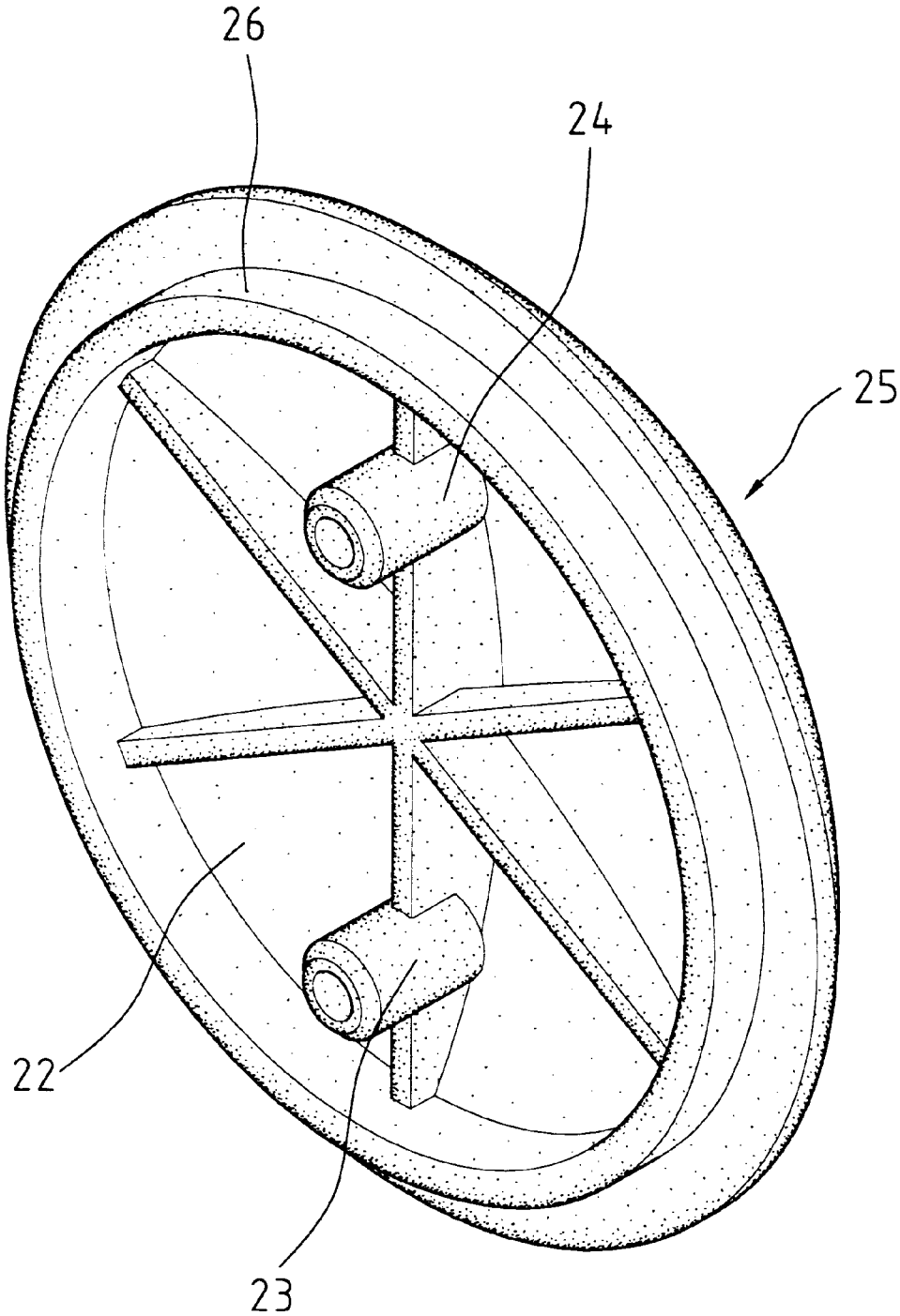
FIG. 3 is a perspective view of a cover of the armrest in accordance with the present invention.
Figure 4:
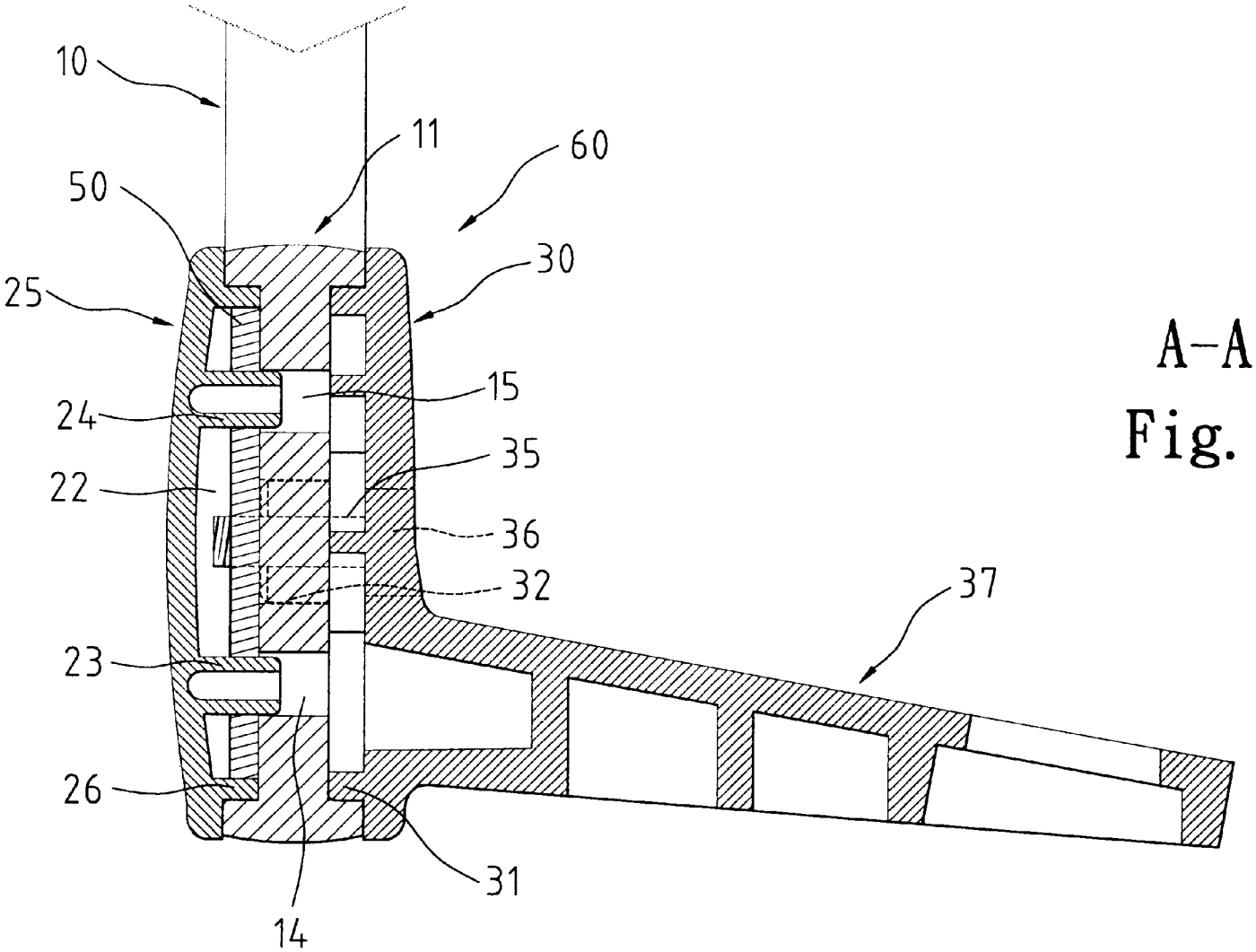
FIG. 4 is a sectional view taken along line A—A in FIG. 2.

The cover 25 has a diameter slightly greater than that of the mounting portion 11. An annular wall 26 (FIG. 4) is formed on an inner side of the cover 25 that faces the first recess 12. A space 22 is defined by the annular wall 26 that has an outer diameter slightly smaller than an inner diameter of the first recess 12 of the mounting portion 11. The annular wall 26 is thus fittingly mounted into the first recess 12. Two engaging members (in the form of stubs 23 and 24, FIG. 3) are formed on the inner side of the cover 25 and inside the annular wall 26. The stubs 23 and 24 are extended into the holes 14 and 15 of the mounting portion 11 when the cover is mounted to the first side of the mounting portion 11, as shown in FIG. 4. The outer side of the cover 25 includes a dome, best shown in FIG. 4.

The fixing plate 50 is circular and fittingly mounted in the space 22 defined by the annular wall 26 of the cover 25. The fixing plate 50 includes two diametrically disposed stub holes (through-holes) 51 and 52 through which the stubs 23 and 24 extend, respectively. The fixing plate 50 further includes screw holes 53, 54, 55, 56, 57, 58 arranged in positions to be respectively aligned with corresponding through-holes 16, 17, 18, 19, 20, 21 of the mounting portion 11.

The attachment means 60 includes a first attachment member 30 and a second attachment member 37. The first attachment member 30 is a circular disc having a diameter slightly greater than that of the mounting portion 11 of the main body 10. The first attachment member 30 includes an annular wall 31 formed on an inner side thereof that faces the second recess 13 of the mounting portion 11. The annular wall 31 has an outer diameter slightly smaller than an inner diameter of the second recess 13 for easily and fittingly mounting the annular wall 31 into the second recess 13. Two projections 32 and 33 are formed on the inner side of the first attachment member 30 and inside the annular wall 31, each projection 32, 33 having a through-hole 34, 35 through which a bolt 36 is extended for engaging with one of an associated screw hole 53, 54, 55, 56, 57, 58. The second attachment member 37 is securely attached to or integrally formed with an outer side (preferably a dome) of the first attachment member 30. The second attachment member 37 has a plurality of holes 38, 39, 40 for connection with a chair seat (not labeled, see FIG. 7) or a chair frame.

Figure 7:
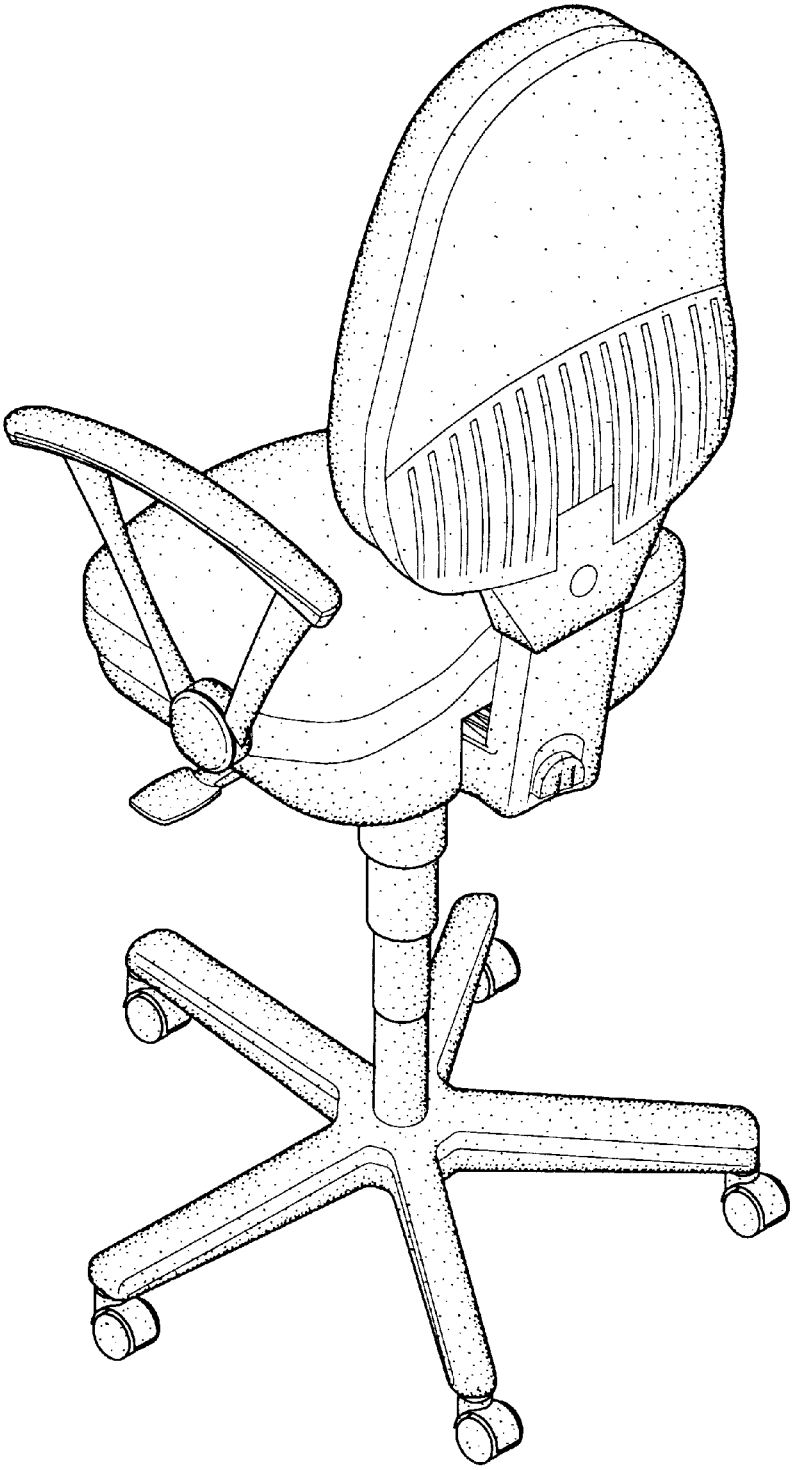
FIG. 7 is a perspective view illustrating application of the armrest in accordance with the present invention to an office chair.

As shown in FIG. 4, the fixing plate 50 is mounted in the space 22 defined by the annular wall 26 of the cover 25, in which the stubs 23 and 24 are respectively extended through the holes 51 and 52 of the fixing plate 50. The cover 50 is then mounted to the first side of the mounting portion 11 of the main body 10. The annular wall 26 is received in the first recess 12 and the stubs 23 and 24 are respectively extended through the engaging holes 14 and 15 of the mounting portion 11. The first attachment member 30 is mounted to the second side of the mounting portion 11 in which the annular wall 31 is received in the second recess 13 and the through-holes 34 and 35 of the projections 32 and 33 are respectively aligned with two of the screw holes 53, 54, 55, 56, 57, 58. Bolts 36 are extended through the through-holes 34 and 35 and the associated screw holes. FIG. 7 illustrates application of the armrest in accordance with the present invention to an office chair.

Figure 5:
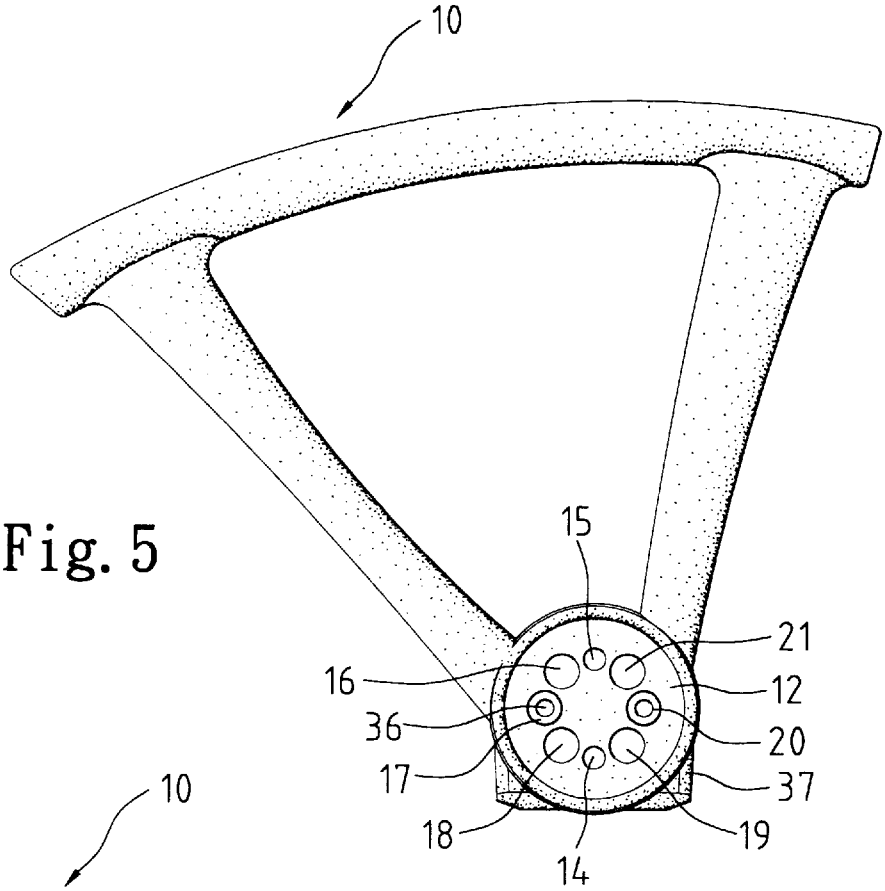
FIG. 5 is a side view of the armrest in accordance with the present invention, wherein the cover and a fixing plate of the armrest are removed for clarity.
Figure 6:
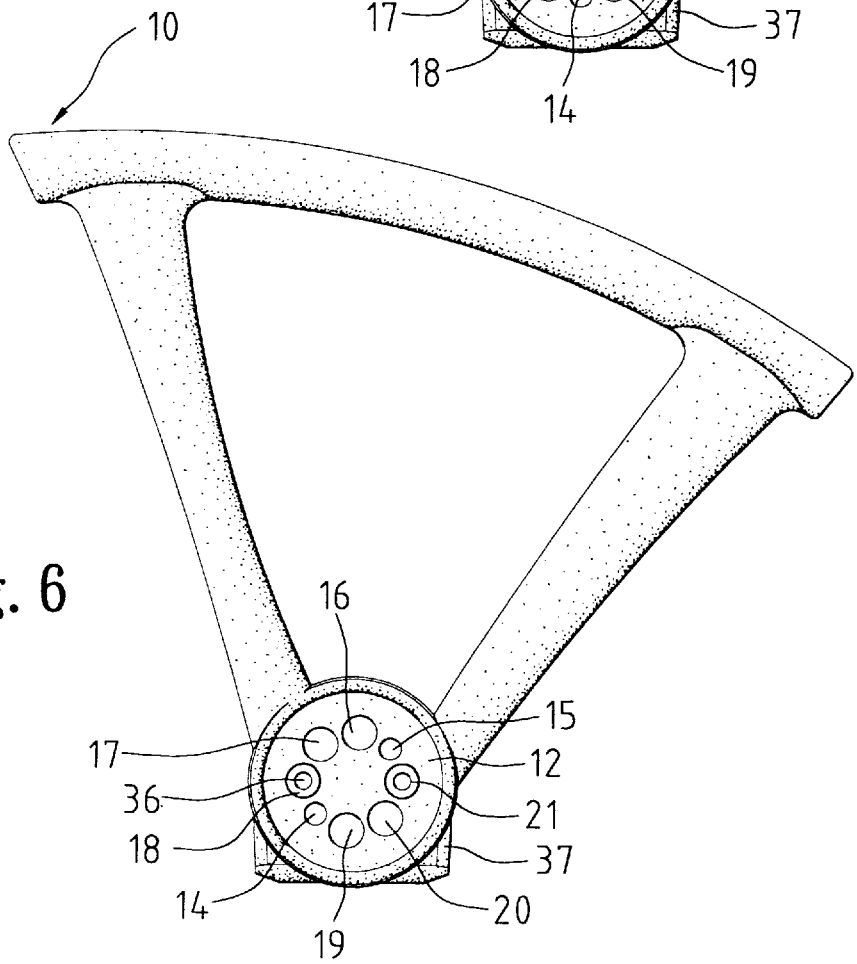
FIG. 6 is a side view similar to FIG. 5, wherein the armrest main body is in a different angular position.

The armrest in FIG. 5 is in an upright position relative to the chair seat (not shown). It is noted that the through-holes 34 and 35 of the projections 32 and 33 are aligned with screw holes 54 and 57 (see FIG. 2) of the fixing plate 50 and holes 17 and 20 of the mounting portion 11, respectively. Nevertheless, inclination angle of the armrest can be adjusted relative to the chair seat. First, the bolts 36 are removed from the first attachment member 30, the armrest main body 10 is turned through a required angle (e.g., 45°) such that the through-holes 34 and 35 of the projections 32 and 33 are aligned with screw holes 55 and 58 (see FIG. 2) of the fixing plate 50 and holes 18 and 21 of the mounting portion 11. The bolts 36 are then remounted to finish the adjustment, as shown in FIG. 6. Thus, the angular position of the armrest main body 10 on which the user's arm rests can be easily and quickly adjusted relative to the chair seat to thereby provide improved sitting comfort.

In addition, trademark of the manufacturer of the armrest may be marked on the armrest. Assembly of the armrest to the chair seat is simple and easy. In addition, in a case that the armrest is damaged in a certain part, the user may only replace the damaged portion instead of replacing the whole armrest, thereby saving the repair cost. Furthermore, the user may replace the armrest with a new one having a different color for bringing a change in a monotonous office.

Although the invention has been explained in relation to its preferred embodiment, it is to be understood that many other possible modifications and variations can be made without departing from the spirit and scope of the invention as hereinafter claimed.

What is claimed is:

1. An armrest comprising:

a main body including a mounting portion having a first side with a first recess and a second side with a second recess, the first recess and the second recess being separated by a partition wall therebetween, the partition wall including at least one engaging hole and at least two first through-holes;

a cover attached to the first side of the mounting portion, the cover including at least one engaging member extended from a side thereof, a fixing plate being securely attached to the side of the cover, the fixing plate including at least one second through-hole, said at least one engaging member of the cover being extended through said at least one second through-hole of the fixing plate and said at least one engaging hole of the partition wall, the fixing plate further including at least two screw holes respectively aligned with said at least two first through-holes of the partition wall; and an attachment means having a first end mounted to the second side of the mounting portion and a second end adapted to be releasably mounted to a chair, the first end of the attachment means including a first attachment member and the second end of the second attachment member that is integrally formed with the first attachment member, the first attachment member including at least one projection formed on a side thereof, said at least one projection having a third through-hole therein, further comprising a bolt extended through the third through-hole of said at least one projection and one of said at least two first through-holes of the partition wall and engaged with one of said at least two screw holes of the fixing plate;

whereby the main body has a plurality of angular positions relative to the attachment means and is swivelable relative to the attachment means when the bolt is removed, the main body is releasably engaged with the first attachment member and retained in one of the angular position by the bolt.

2. The armrest as claimed in claim 1, wherein the side of the cover includes an annular wall defining a space therein, said at least one engaging member being located in the space, the fixing member having a diameter slightly smaller than an inner diameter of the annular wall so as to be fittingly received in the space, the annular wall having an outer diameter slightly smaller than an inner diameter of the first recess so as to be fittingly received in the first recess.

3. The armrest as claimed in claim 1, wherein the side of the first attachment member includes an annular wall, said at least one projection being located inside the annular wall, the annular wall having an outer diameter slightly smaller than an inner diameter of the second recess so as to be fittingly received in the second recess.

4. The armrest as claimed in claim 1, wherein the second attachment member includes at least one hole for engaging with a chair seat.

5. An armrest comprising:

a main body including a mounting portion having a first side with a first recess and a second side with a second recess, the first recess and the second recess being separated by a partition wall therebetween, the partition wall including two diametrically disposed engaging holes and a plurality of annularly spaced first through-holes;

a cover attached to the first side of the mounting portion, the cover including two diametrically disposed engaging members extended from a side thereof, a fixing plate being securely attached to the side of the cover, the fixing plate including two second through-hole, said engaging members of the cover being extended through said second through-holes of the fixing plate and said engaging holes of the partition wall, the fixing plate further including a plurality of screw holes respectively aligned with the first through-holes of the partition wall; and an attachment means having a first attachment member mounted to the second side of the mounting portion and a second attachment member that is integrally formed with the first attachment member and that is adapted to be releasably mounted to a chair, the first attachment member including two diametrically disposed projections formed on a side thereof, each said projection having a third through-hole therein, further comprising two bolts each of which is extended through the third through-hole of each said projection and one of said first through-holes of the partition wall and engaged with one of said screw holes of the fixing plate;

whereby the main body has a plurality of angular positions relative to the attachment means and is swivelable relative to the attachment means when the bolts are removed, the main body is releasably engaged with the first attachment member and retained in one of the angular positions by said bolts.

6. The armrest as claimed in claim 5, wherein the side of the cover includes an annular wall defining a space therein, said at least one engaging member being located in the space, the fixing member having a diameter slightly smaller than an inner diameter of the annular wall so as to be fittingly received in the space, the annular wall having an outer diameter slightly smaller than an inner diameter of the first recess so as to be fittingly received in the first recess.

7. The armrest as claimed in claim 5, wherein the side of the first attachment member includes an annular wall, said at least one projection being located inside the annular wall, the annular wall having an outer diameter slightly smaller than an inner diameter of the second recess so as to be fittingly received in the second recess.

8. The armrest as claimed in claim 5, wherein the second attachment member includes at least one hole for engaging with a chair seat.

* * * * *